US012736307B2

(12) United States Patent
Patel et al.

(10) Patent No.: US 12,736,307 B2
(45) Date of Patent: Sep. 15, 2026

(54) ENHANCED PRECISION DISTURBED ZERO SIGHTING SYSTEM FOR LONG-RANGE TARGET ENGAGEMENT

(71) Applicants: Jagrut Patel, Sunrise, FL (US); Sumeet Suri, Sunrise, FL (US)

(72) Inventors: Jagrut Patel, Sunrise, FL (US); Sumeet Suri, Sunrise, FL (US)

( * ) Notice: Subject to any disclaimer, the term of this patent is extended or adjusted under 35 U.S.C. 154(b) by 71 days.

(21) Appl. No.: 18/808,645

(22) Filed: Aug. 19, 2024

(65) Prior Publication Data

US 2026/0071847 A1 Mar. 12, 2026

Related U.S. Application Data

(60) Provisional application No. 63/571,683, filed on Mar. 29, 2024.

(51) Int. Cl.

| | |
|---|---|
| ***F41G 3/16*** | (2006.01) |
| ***F41G 1/38*** | (2006.01) |
| ***F41G 3/08*** | (2006.01) |

(52) U.S. Cl.

CPC ..... *F41G 3/165* (2013.01); *F41G 1/38* (2013.01); *F41G 3/08* (2013.01)

(58) Field of Classification Search

CPC ..... F41G 1/36; F41G 3/08; F41G 3/14; F41G 3/16; F41G 3/165; F41G 3/18

USPC ..... 42/122

See application file for complete search history.

(56) References Cited

U.S. PATENT DOCUMENTS

| | | | | |
|---|---|---|---|---|
| 4,760,770 | A * | 8/1988 | Bagnall-Wild | F41G 3/323 89/41.06 |
| 5,171,933 | A * | 12/1992 | Eldering | F41G 3/165 89/41.21 |
| 5,375,072 | A * | 12/1994 | Cohen | F41G 3/06 235/417 |
| 5,456,157 | A * | 10/1995 | Lougheed | F41G 3/08 89/134 |
| 6,769,347 | B1 * | 8/2004 | Quinn | F41G 3/06 89/41.09 |
| 8,833,655 | B2 * | 9/2014 | McCarty | F41G 1/00 359/422 |
| 2005/0198885 | A1 * | 9/2005 | Staley, III | F41G 1/48 42/142 |
| 2012/0097741 | A1 * | 4/2012 | Karcher | F41G 1/473 235/404 |
| 2012/0167439 | A1 * | 7/2012 | Jock | F41G 3/165 42/130 |
| 2015/0143732 | A1 * | 5/2015 | Choiniere | F41G 1/54 42/111 |

(Continued)

*Primary Examiner* — Troy Chambers
*Assistant Examiner* — Benjamin S Gomberg
(74) *Attorney, Agent, or Firm* — The Rapacke Law Group, P.A.; Andrew Rapacke; Ken Brooks

(57) ABSTRACT

A weapon sighting system and method are provided for engaging distant targets with precision. The system includes an in-line or clip-on weapon sight integrated with a fire control system (FCS) that generates ballistic messages for Elevation (ELEV) HOLD and Windage (WIND) HOLD. A sensor capable of detecting various infrared wavelengths is included, allowing for periscopic or prism transforms based on the ballistic solution for a target. This disclosed system enables shooters to engage targets with high accuracy and precision at extreme ranges without losing sight of the firing solution when increasing magnification.

19 Claims, 7 Drawing Sheets

(56) References Cited

U.S. PATENT DOCUMENTS

2021/0190456 A1* 6/2021 Patel ..... F41G 1/32
2025/0004285 A1* 1/2025 Havens ..... G02B 27/0172

* cited by examiner

ENHANCED PRECISION DISTURBED ZERO SIGHTING SYSTEM FOR LONG-RANGE TARGET ENGAGEMENT

CROSS-REFERENCE TO RELATED APPLICATIONS

This application claims priority to U.S. Provisional Application Ser. No. 63/571,683, filed March. 29, 2024, entitled "Disturbed Zero for Extreme Long Range Target Engagement," incorporated by reference herein.

FIELD OF DISCLOSURE

The present invention disclosure generally relates to long-range precision targeting systems, and more particularly, to an advanced sighting system for firearms that integrates ballistic computation with optical aiming components.

BACKGROUND

Historically, long-range shooters maintained detailed records of weapon and ammunition performance across various conditions to reference before engaging distant targets. With the advent of edge computing, ballistic solvers such as Applied Ballistics, Hornady, and others began providing shooters with elevation and windage holds derived from laser range finder measurements. While current devices integrate ballistic solvers and sensors, and even though weapons mounted FCS can provide ballistic data to sights like the VooDoo™ thermal weapon sight, they still present limitations in terms of speed versus accuracy and visible MILS at higher magnifications.

Accordingly, an advanced sighting system for firearms that integrates ballistic computation with optical aiming components is desired.

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

The embodiments of the present disclosure provide an improved weapon sighting system that integrates an in-line or clip-on weapon sight with a weapon-mounted or integrated FCS, facilitating quick and precise engagement of distant targets. It offers a Disturbed Zero feature that adjusts the weapon's clear view optic to the ballistic solution provided by the FCS, allowing shooters to use high magnification without losing the firing solution. The system includes a remote control, a clear view optic with an etched reticle, and a sensor for various infrared wavelength detection. The weapon sight sensor and/or the display are designed to undergo specific transforms, enhancing the shooter's ability to engage targets accurately.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings may contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
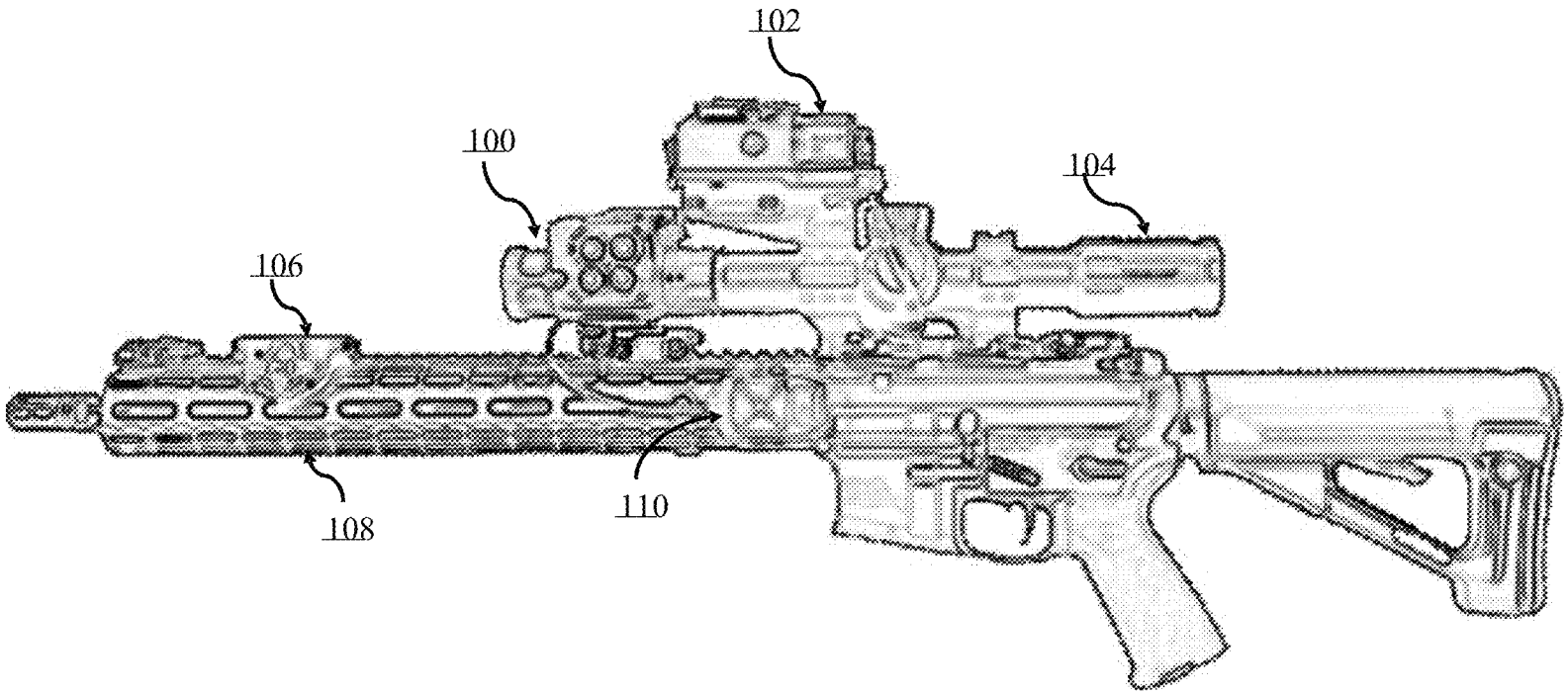
FIG. 1 depicts the weapon sighting system configuration, showing the connection of an in-line/clip-on weapon sight with a remote control and a weapon-mounted integrated FCS, all mounted on a weapon rail.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such a term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subject matter disclosed under the header.

The present disclosure includes many aspects and features. Moreover, while many aspects and features relate to, and are described in the context of the loan processing, embodiments of the present disclosure are not limited to use only in this context.

The present disclosure provides a method and system for dynamically adjusting the sighting system zero in accordance with computed ballistic solutions, thereby enhancing the accuracy and efficiency of engaging targets at varying distances under different environmental conditions. This involves the application of periscopic or prism transforms to the sighting mechanisms based on real-time ballistic data, optimizing the shooter's ability to maintain visual contact with the target while applying the necessary elevation and windage adjustments digitally. The system is particularly relevant to the fields of military and law enforcement operations, competitive shooting, and hunting where extreme long-range precision is required.

In the realm of Extreme Long Range (ELR) shooting, practitioners meticulously calibrate their equipment—a synthesis of weaponry, ammunition, and optics—to the specifics of their operational theatre, as exemplified in FIG. 1. Here, numeral 100 signifies an in-line or clip-on weapon sight allied with a remote control 106 and an integrated fire control system (FCS) mounted on the weapon 102. The remote control 110 commands the FCS 102. Both the in-line/clip-on sight 100 and the clear view optic 104 are affixed via a rail to the firearm 108. Upon initiation of a ranging sequence via the integrated FCS 102, a ballistic message is dispatched to the in-line/clip-on sight 100, which consequently adjusts its reticle in response to the calculated ELEV and WIND holds. The clear view optic 104, observing through the in-line/clip-on sight 100, then aligns the disturbed reticle with the target in preparation for projectile discharge.

Figure 2:
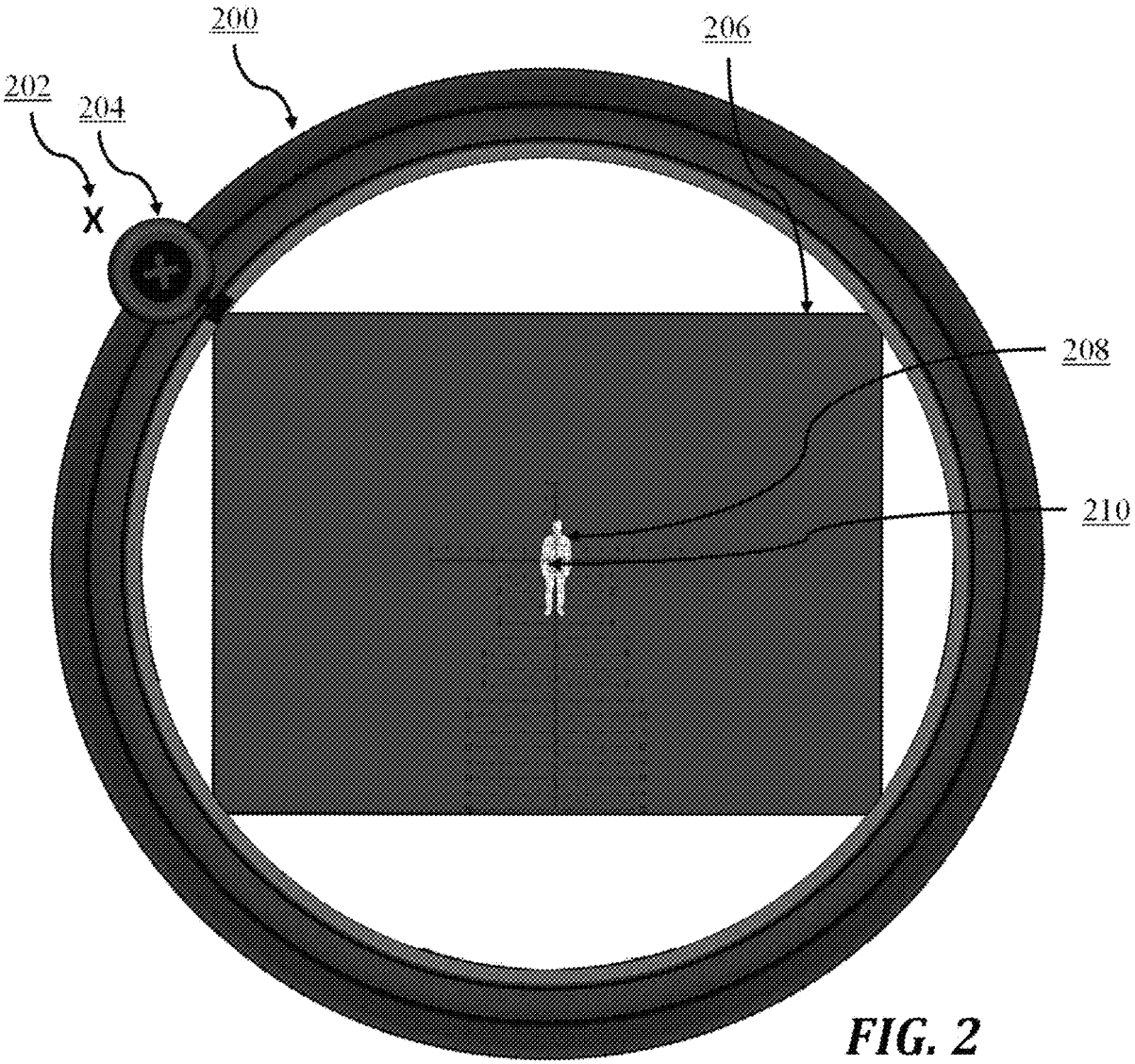
FIG. 2 illustrates the optical setup from a shooter's perspective, with a clear view optic observing an image produced by an in-line/clip-on weapon sight and adjustments for magnification to counteract tunneling effects.

FIG. 2 illustrates the optical configuration from the shooter's vantage point. The clear view optic 200 views the image output from the in-line/clip-on sight 206, which is calibrated to a baseline magnification of 1×—defining the ratio of the field of view at entry (FOV-IN) to that at exit (FOV, OUT). In-line/clip-on sights 206, typically characterized by a limited FOV, necessitate an adjustment in magnification 204 at the clear view optic 200 to counteract the tunnel vision effect. The apparent size of target 208 within this arrangement is a function of the in-line/clip-on sight's instantaneous field of view (IFOV), the distance to target 208, and the inherent dimensions of the target itself. An increased proximity of the target 208 to the sight 206 results in a larger perceived target image. Additionally, the clear view optic 200 is equipped with an etched reticle 210, which is tunable for Elevation and Windage, thereby zeroing the optic to the firearm and featuring various patterns to indicate different ELEV and WIND settings in MILS, MOA, or distance measurements.

Figure 3:
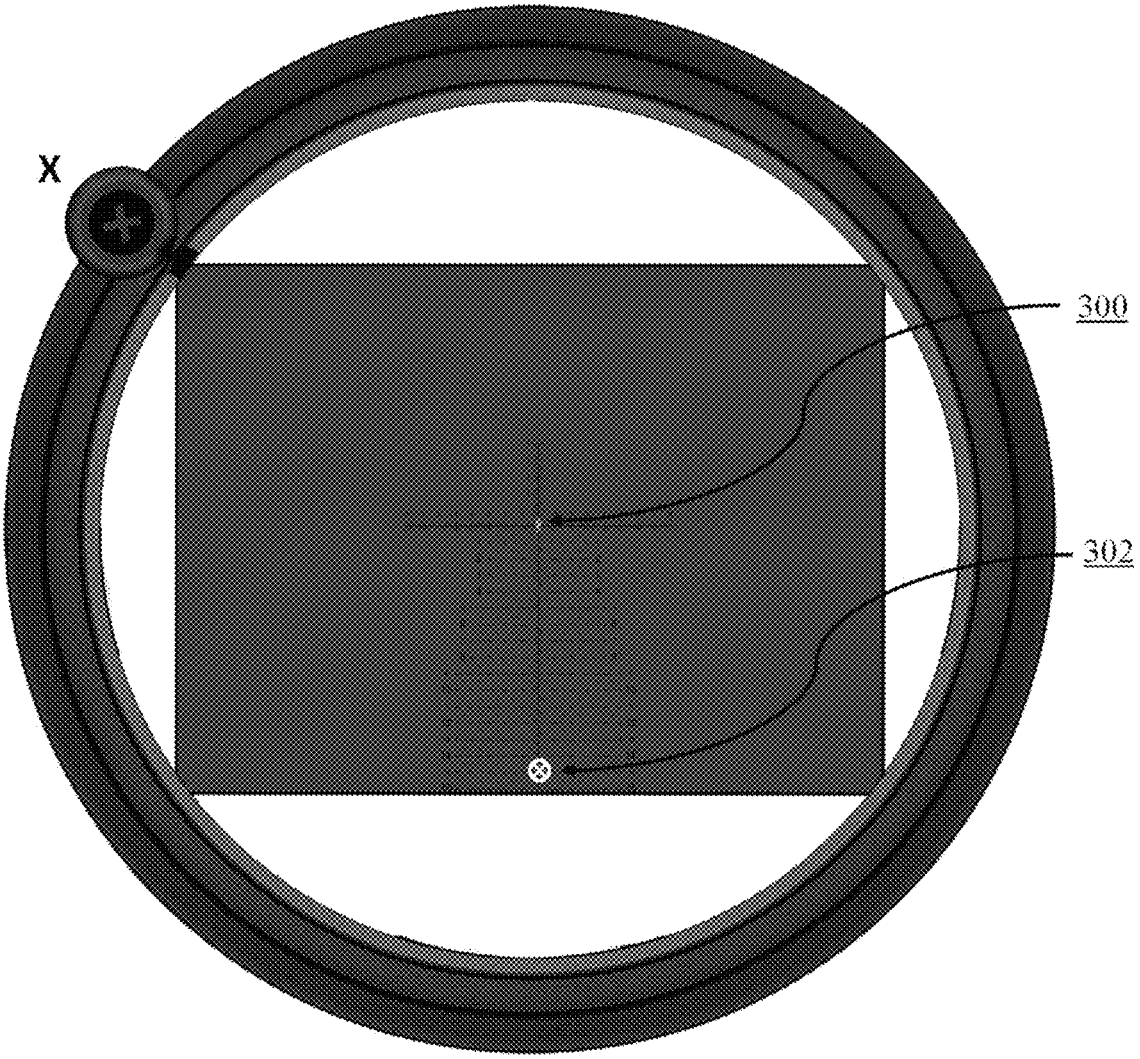
FIG. 3 shows a distant target as it appears through the in-line/clip-on weapon sight, with the firing solution displayed near the bottom edge.

In FIG. 3, the portrayal of a distant target 300 exhibits its minuscule appearance, with the firing solution or ELEV hold 302 positioned near the bottom periphery of the in-line/clip-on weapon sight's visual display.

Figure 4:
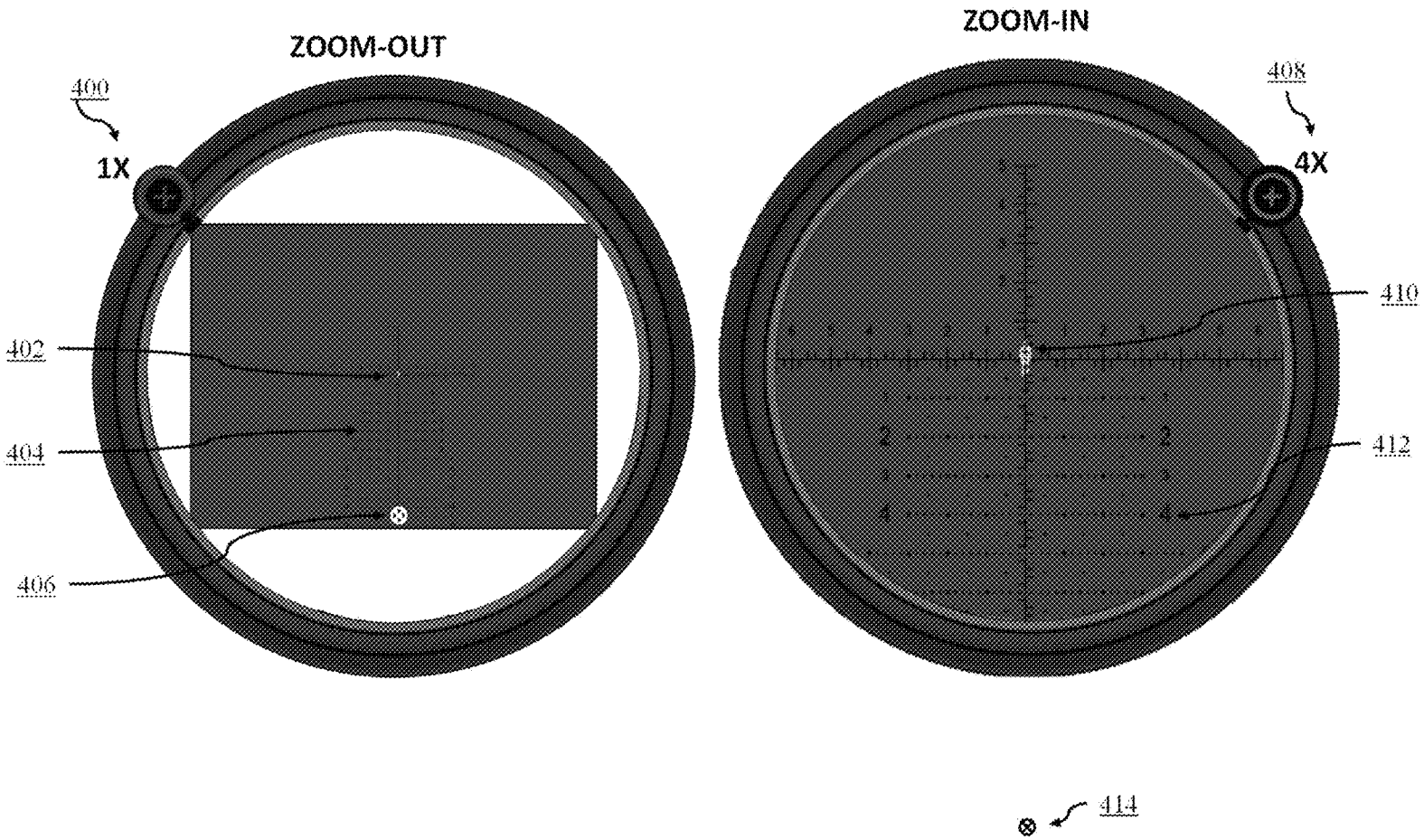
FIG. 4 displays the change in target appearance with optical magnification adjustments and the limitations of the HOLD E+W approach when higher magnifications reduce visible MILS.

FIG. 4 presents the visual constraints encountered when engaging a distant, diminutive target 402 with a baseline optical magnification set at 1× 400. The shooter can discern the firing solution 406 and is capable of engaging the target 402 using either the etched reticle 404 on the clear view optic or the disturbed reticle 406 on the in-line/clip-on sight. Amplification of optical magnification 408 on the clear view optic to enhance the size of the target 410 inadvertently diminishes the visible MILS on the etched reticle 412, causing the firing solution 414 to escape the shooter's field of view.

This constraint necessitates the need for the shooter to Dial Elevation MILS, concurrently magnifying the target image and retaining visibility of the firing solution. The integration of the weapon-mounted FCS, synchronized with the zeroing of the optic, poses a limitation; once Elevation MILS are dialed, the FCS's ranging capacity is suspended until the optic is reset to its zero mark, impacting the rapidity of target engagement when utilizing the DIAL E+W method.

Figure 5:
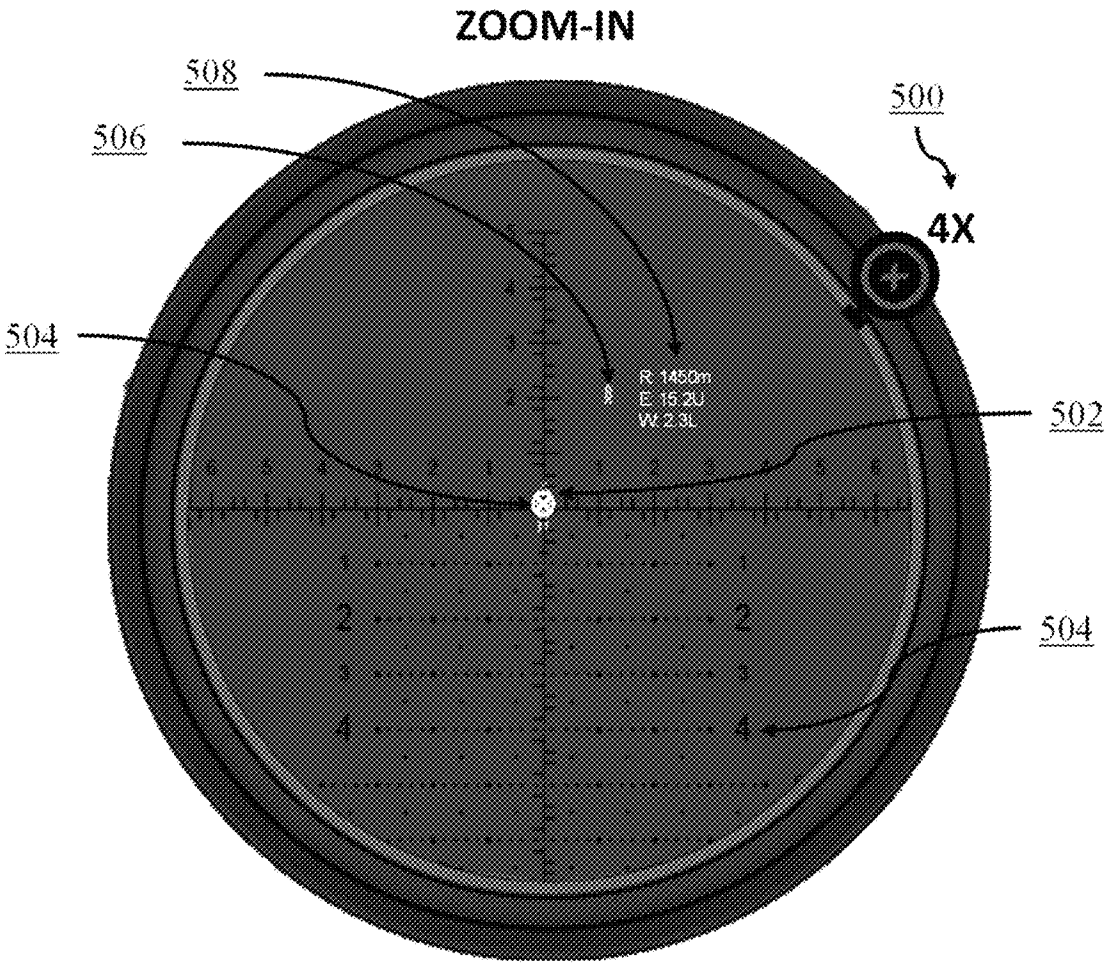
FIG. 5 demonstrates a Disturbed Zero in-line/clip-on weapon sight where the firing solution is displayed, enabling the shooter to engage a distant target with high magnification at the weapon zero point.

The innovative Disturbed Zero in-line/clip-on weapon system, delineated in FIG. 5, revolutionizes the approach by transfiguring the clear view optic's zero point to align with the ballistic solution 508 furnished by the weapon-mounted FCS, thus enabling the sharpshooter to confront distant targets 502 with heightened magnification 500 at the firearm's zero point 504. While the operator can perceive where the disturbed zero transformation occurs within the in-line/clip-on system, a digital marker 506 provides an additional visual indication that the firing solution has been perturbed on the sight.

Experts in the field will recognize that the display on the Disturbed Zero in-line/clip-on sight may compensate, without any loss of general applicability or specificity, for various combinations of Elevation and Windage holds, whether it be ELEV+Windage Hold, ELEV Hold alone, Windage Hold alone, or ELEV+a constant Wind Hold (e.g., '0 MPH/KPH/meters per second'). Moreover, the disturbed zero in-line/clip-on sight and the weapon-mounted integrated FCS may function as independent units or as an integrated system upon the weapon platform.

Figure 6:
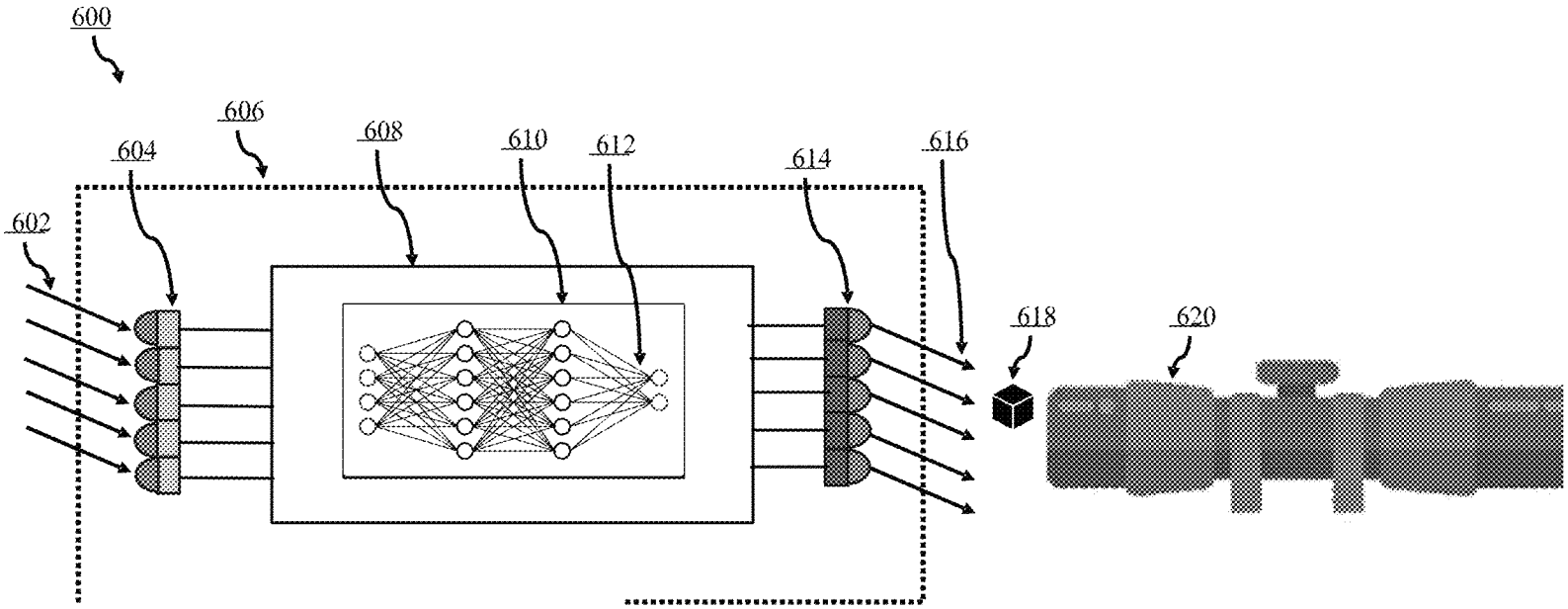
FIG. 6 depicts the electronics and chipsets applying periscopic/prism transforms based on the ballistic solution, aligning the target with the appropriate ELEV and WIND holds.

FIG. 6 portrays a chipset 610 embedded within the system's electronics 608, hosting computer-readable media 612 that effectuates periscopic/prism transformations upon the sensor, display, or both, in alignment with the IFOV and the ballistic solution for target 600 within a collimated in-line/clip-on weapon system 606. This manipulation ensures that photons 602 intercepted by the sensor 604, and photons 616 emitted by the display 614, position the perceived target object 618 at the proper ELEV and WIND Hold coordinates relative to the clear view optic 620.

In one embodiment, the periscopic/prism transformations are implemented as follows:

Transformation [x,y]->[X=x+/−ELEV Mils/{focal length/Pixel Pitch}, Y=y], wherein X is calculated for elevation without a wind correction; and Transformation [x,y]->[X=x+/−ELEV Mils/{focal length/Pixel Pitch}, Y=y+/−WIND Mils/{focal length/pixel pitch}], wherein X is transformed for elevation and Y is transformed for a wind correction.

Technicians with domain knowledge will appreciate that the sensor 604 within the Disturbed Zero in-line/clip-on sight may comprise an array of wavelength-specific technologies, including but not limited to LWIR, MWIR, SWIR, NIR, a combination of MWIR+SWIR, MWIR+LWIR, VIS-NIR, VISIR, etc. Additionally, the disturbed zero transformation may apply variously to the sensor, the display, or both elements in tandem.

These professionals may also understand that the computer-readable media 612 responsible for the periscopic/prism transformations may operate across various platforms, such as FPGA, CPLD, processors, ASICs, among others. These transformations can be affected electronically by modulating the sensor and/or display data, or via the employment of optical prism components situated upon the sensor, the display, or both.

Figure 7:
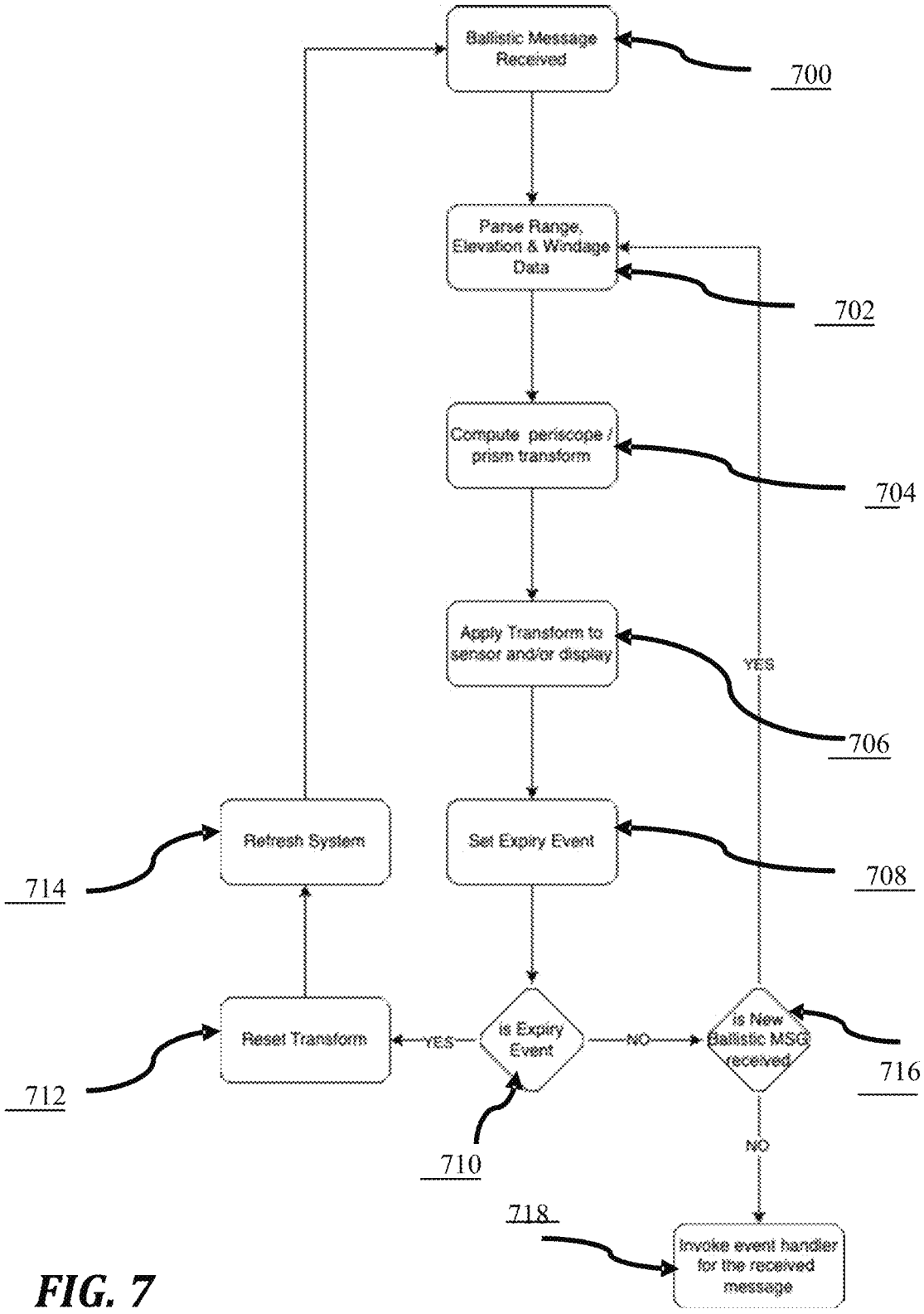
FIG. 7 outlines the method of applying disturbed zero to an in-line/clip-on weapon system, where the system receives and processes ballistic messages and applies the necessary transforms.

The methodology of applying the disturbed zero effect within the in-line/clip-on weapon system is depicted in FIG. 7. Here, the system receives a ballistic message 700 from either an internal or external integrated FCS. The ballistic data is dissected 702 for Range, Elevation, Windage, among other parameters, and contingent upon the shooter's preferences, the relevant Elevation and/or Windage periscopic/prism transformation 704 is executed upon the sensor and/or display 706 for a duration specified by the operator 708. Following the lapse of this specified time frame 710, the transformations are retracted 712, and the system is reinstated to the clear view optic's zero reference 714, ready to process a new ballistic message 700. Should a fresh ballistic message 716 arrive amid an active shooter-s.

All rights including copyrights in the code included herein are vested in and the property of the Applicant. The Applicant retains and reserves all rights in the code included herein, and grants permission to reproduce the material only in connection with reproduction of the granted patent and for no other purpose.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as examples for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

What is claimed is:

1. A disturbed zero optical sighting system for firearms, comprising:

an in-line/clip-on weapon sight capable of receiving ballistic data and disturbing an image output based on calculated elevation (ELEV) and wind (WIND) holds;

a clear view optic configured to align an etched reticle with a target when viewed through the in-line/clip-on weapon sight; and a firearm-mounted integrated fire control system (FCS) configured to send the ballistic data to the in-line/clip-on weapon sight;

wherein the in-line/clip-on weapon sight disturbs the image output such that the target can be engaged at a zero position of the etched reticle of the clear view optic without requiring any adjustment for the ELEV and WIND holds; and wherein the in-line/clip-on weapon sight comprises a chipset configured to execute elevation and windage periscopic/prism transformations within the sighting system based on the ballistic data, wherein the periscopic/prism transformations comprise:

[x,y]→[X=x±ELEV mils/{focal length/Pixel Pitch}, Y=y], wherein X is calculated for elevation without a wind correction; or

[x,y]→[X=x±ELEV Mils/{focal length/Pixel Pitch}, Y=y±WIND mils/{focal length/pixel pitch}], wherein X is transformed for elevation and Y is transformed for a wind correction.

2. The optical sighting system of claim 1, wherein the chipset is configured for electronically modulating a perception of the target within the sighting system based on the ballistic data, characterized by a disturbed zero effect in the in-line/clip-on weapon sight.

3. The optical sighting system of claim 2, wherein the in-line/clip-on weapon sight is configured to disturb a sensor output based on a distance of the target and the ballistic data.

4. The optical sighting system of claim 3, wherein the in-line/clip-on weapon sight is configured to disturb the sensor output and a display output based on the distance of the target and the ballistic data.

5. The optical sighting system of claim 2, wherein the in-line/clip-on weapon sight is configured to disturb a display output based on a distance of the target and the ballistic data.

6. The optical sighting system of claim 2, further comprising a sensor array within the in-line/clip-on weapon sight comprising any of: LWIR, MWIR, a combination of MWIR and SWIR, SWIR, NIR, VISNIR, and VISIR.

7. The optical sighting system of claim 2, wherein the in-line/clip-on weapon sight is configured to disturb the image output at least based on the ELEV hold.

8. The optical sighting system of claim 2, wherein the in-line/clip-on weapon sight is configured to disturb the image output based on the ELEV hold and to apply a spindrift at zero wind speed for the WIND hold.

9. A method for targeting in a disturbed zero optical sighting system for firearms, comprising:

receiving ballistic data in an in-line/clip-on weapon sight mounted on a firearm;

disturbing an image of the in-line/clip-on weapon sight based on the received ballistic data;

aligning an etched reticle of a clear view optic with a target observed through the disturbed image of the in-line/clip-on weapon sight;

wherein disturbing the image comprises modifying the image based on elevation and wind holds; and further comprising executing elevation and windage periscopic/prism transformations within the sighting system based on the ballistic data, wherein the periscopic/prism transformations comprise:

[x,y]→[X=x±ELEV mils/{focal length/Pixel Pitch}, Y=y], wherein X is calculated for elevation without a wind correction; or

[x,y]→[X=x±ELEV Mils/{focal length/Pixel Pitch}, Y=y±WIND mils/{focal length/pixel pitch}], wherein X is transformed for elevation and Y is transformed for a wind correction.

10. The method of claim 9, further comprising dynamically disturbing the image of the in-line/clip-on weapon sight based on a distance to the target to alter an apparent position of a target image.

11. The method of claim 9, further comprising:

maintaining the periscopic/prism transformations for a predetermined duration specified by an operator.

12. The method of claim 11, further comprising reverting the disturbed zero optical sighting system to a zero reference of the clear view optic upon expiration of the predetermined duration.

13. The method of claim 9, further comprising applying a spindrift correction at zero wind speed for the wind hold.

14. A disturbed zero optical sighting system for a firearm, comprising:

an integrated fire control system (FCS) configured to provide ballistic data;

an in-line/clip-on weapon sight adjustably mounted on the firearm and capable of receiving the ballistic data from the FCS; and a clear view optic coupled with the in-line/clip-on weapon sight comprising an etched reticle adjustable for Elevation and Windage, wherein the in-line/clip-on weapon sight implements a disturbed zero transformation aligning with a ballistic solution determined from the ballistic data provided by the FCS; and wherein the in-line/clip-on weapon sight comprises a chipset configured to perform periscopic/prism transformations upon a sensor, a display, or both, based on the received ballistic data, the periscopic/prism transformations comprising one of:

[x,y]→[X=x±ELEV mils/{focal length/Pixel Pitch}, Y=y], wherein X is calculated for elevation without a wind correction; and

[x,y]→[X=x±ELEV Mils/{focal length/Pixel Pitch}, Y=y±WIND mils/{focal length/pixel pitch}], wherein X is transformed for elevation and Y is transformed for a wind correction.

15. The system of claim 14, wherein the chipset comprises a processor and a computer-readable media that when executed on the processor causes execution of the periscopic/prism transformations based on the ballistic data.

16. The system of claim 15, wherein the periscopic/prism transformations are executed on the chipset comprising any of: FPGA, CPLD, and ASICs.

17. The system of claim 15, wherein the computer-readable media when executed on the processor causes maintaining the periscopic/prism transformations for a predetermined duration specified by an operator and reverting the system to a zero reference of the clear view optic upon expiration of the predetermined duration.

18. The system of claim 14, wherein the periscopic/prism transformations comprise

[x,y]→[X=x±ELEV mils/{focal length/Pixel Pitch}, Y=y], wherein X is calculated for the elevation without a wind correction.

19. The system of claim 14, wherein the periscopic/prism transformations comprise

[x,y]→[X=x±ELEV Mils/{focal length/Pixel Pitch}, Y=y±WIND Mils/{focal length/pixel pitch}], wherein X is transformed for the elevation and Y is transformed for a wind correction.

* * * * *